US008659348B2

(12) United States Patent
López Rodriguez et al.

(10) Patent No.: US 8,659,348 B2
(45) Date of Patent: Feb. 25, 2014

(54) CURRENT MIRRORS

(75) Inventors: Juan Luis López Rodriguez, Subirats Barcelona (ES); Sergio Alejandro López Ramos, Barcelona (ES); Javier González Bruno, Terrassa Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/559,156

(22) Filed: Jul. 26, 2012

(65) Prior Publication Data

US 2014/0028382 A1 Jan. 30, 2014

(51) Int. Cl.
*G05F 1/10* (2006.01)

(52) U.S. Cl.
USPC ..... 327/538; 327/545; 327/530

(58) Field of Classification Search
USPC ..... 327/530, 538, 540, 545, 108, 109, 111, 327/112, 403, 405, 407, 411, 412, 478
See application file for complete search history.

(56) References Cited

U.S. PATENT DOCUMENTS

| | | | | |
|---|---|---|---|---|
| 4,029,974 | A * | 6/1977 | Brokaw | 327/512 |
| 5,469,093 | A * | 11/1995 | MacDonald | 327/108 |
| 5,627,486 | A * | 5/1997 | Gross | 327/108 |
| 5,825,218 | A * | 10/1998 | Colli et al. | 327/112 |
| 5,942,934 | A * | 8/1999 | Ngo et al. | 327/540 |
| 5,982,201 | A * | 11/1999 | Brokaw et al. | 327/53 |
| 6,154,018 | A | 11/2000 | Sessions et al. | |
| 6,201,381 | B1 * | 3/2001 | Yasuda | 323/315 |
| 6,278,326 | B1 * | 8/2001 | Murray et al. | 330/288 |
| 6,677,807 | B1 * | 1/2004 | Brokaw | 327/538 |
| 6,876,182 | B1 | 4/2005 | Aude | |
| 7,129,773 | B2 * | 10/2006 | Ito et al. | 327/538 |

FOREIGN PATENT DOCUMENTS

| | | | |
|---|---|---|---|
| EP | 1017164 | A2 | 7/2000 |
| JP | 2000252771 | A | 9/2000 |

OTHER PUBLICATIONS

High Output Impedance Current Mirror, Advanced Linerar Devices, Inc., Design Innovations in Analog Semiconductors, download date: May 24, 2012. <http://www.aldinc.com/pdf/cs_11008.0.pdf>.

Pietro M. Ferreira, et al., Current Mode Read-out Circuit for Infrared Photodiode Applications in 0.35 μm CMOS, on pp. 100-104, 2008, <http://dl.acm.org/citation.cfmid=1404405&dl=ACM&coll=DL &CFID=829877668&CFTOKEN=18460453 >.

* cited by examiner

*Primary Examiner* — Lincoln Donovan
*Assistant Examiner* — Jung H Kim

(57) ABSTRACT

A current mirror comprises first and second sets of transistors. each of the first and second sets is a matched set comprising a first transistor and a second transistor. For each set, the base of the first transistor is directly coupled to the base of the second transistor. For one of the first and second transistors of each set the base is directly coupled to the collector. The collectors of the first and second transistors of the first set are coupled, respectively, to the emitters of the first and second transistors of the second set in series. A current output of the current mirror is coupled between the collector of the second transistor of the first set and the emitter of the second transistor of the second set.

12 Claims, 7 Drawing Sheets

CURRENT MIRRORS

BACKGROUND

Current mirrors are used to force one set of components to output a current proportional in magnitude to the input current to another set of components. This can be used for example to provide a current source.

BRIEF DESCRIPTION OF THE DRAWINGS

Various examples are described below, by way of example only, with reference to the accompanying drawings, in which.

DETAILED DESCRIPTION

There are several kinds of current mirror. The basic current mirror is generally known as a Widlar current mirror, and an example is shown in FIG. 6.

Figure 6:
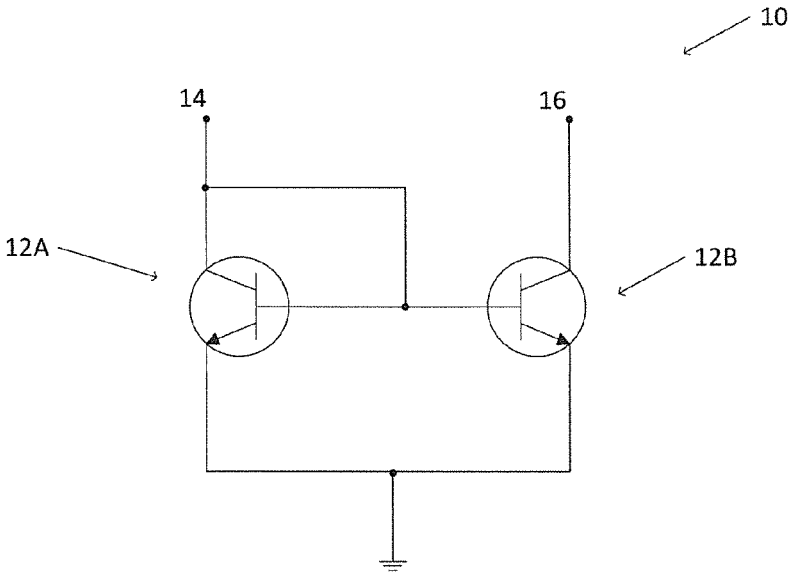
FIG. 6 is a schematic diagram of an example of a Widlar current mirror.

FIG. 6 shows a current mirror 10 comprising a matched (in thermal and electrical characteristics) set of transistors comprising a first transistor 12A and a second transistor 12B. The bases of the transistors 12A and 12B are directly coupled together, and the collector of first transistor 12A is directly coupled to the base of first transistor 12A. The emitters of the transistors 12A and 12B are coupled to ground. An input current is coupled to junction 14, and a mirrored current is produced at junction 16, to which a load can be coupled.

Figure 7:
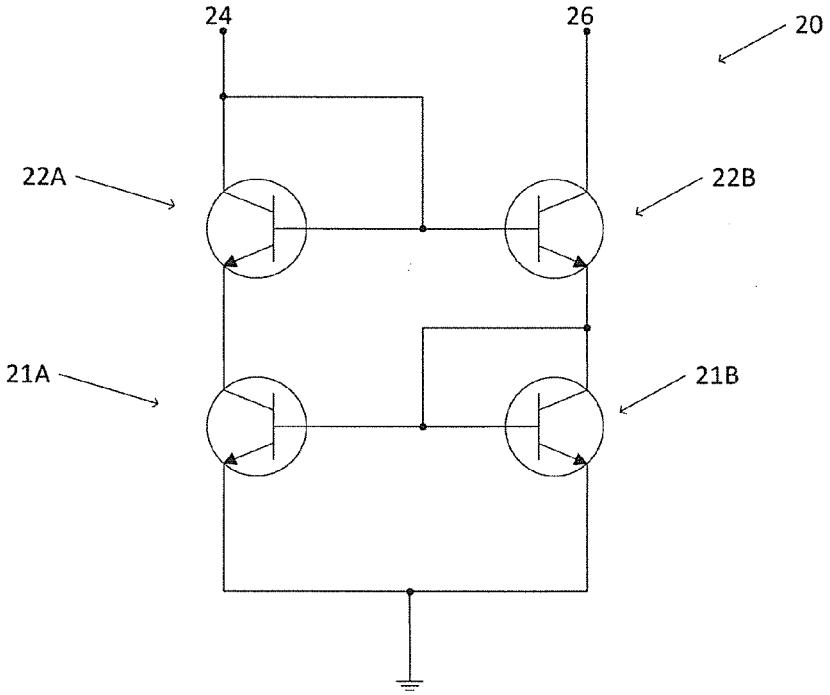
FIG. 7 is a schematic diagram of an example of a Wilson current mirror.

Other types of current mirror include the Wilson current mirror, an example of which is shown in FIG. 7. FIG. 7 shows a current mirror 20 comprising a first set of transistors comprising a first transistor 22A and a second transistor 22B. The bases of the transistors 22A and 22B are directly coupled together, and the collector of first transistor 22A is directly coupled to the base of first transistor 22A. In this example, there is provided a further matched set of transistors comprising a first transistor 21A and a second transistor 21B. The emitter of the first transistor 22A of the first set is coupled to the collector of the first transistor 21A of the further set, and the emitter of second transistor 22B of the first set is coupled to the collector of the second transistor 21B of the further set. In addition, the collector of the second transistor 21B of the further set is directly coupled to its base, and the bases of transistors 21A and 21B are directly coupled together. An input current is coupled to junction 24, and a mirrored current is produced at junction 26, to which a load can be coupled. The emitters of the transistors 21A and 21B are coupled to ground.

The Wilson current mirror is popular due to its simplicity and high performance. It matches currents very well. However, its performance drops when a load presents a high impedance. Indeed, many current mirrors are susceptible to a drop in performance when a load presents a high impedance.

In many current mirrors the performance drop at high load impedances is the result of saturation in the transistors (at approximately Z>Vcc/Iset where Z is the impedance of the load, Vcc is the supply voltage, and Iset is the input current to the current mirror).

Some designs avoid saturation by reducing the voltage in the current sensor/diode connected transistor. This is disadvantageous because the current mirror modifies the current with load and this therefore degrades dynamic response.

Figure 1:
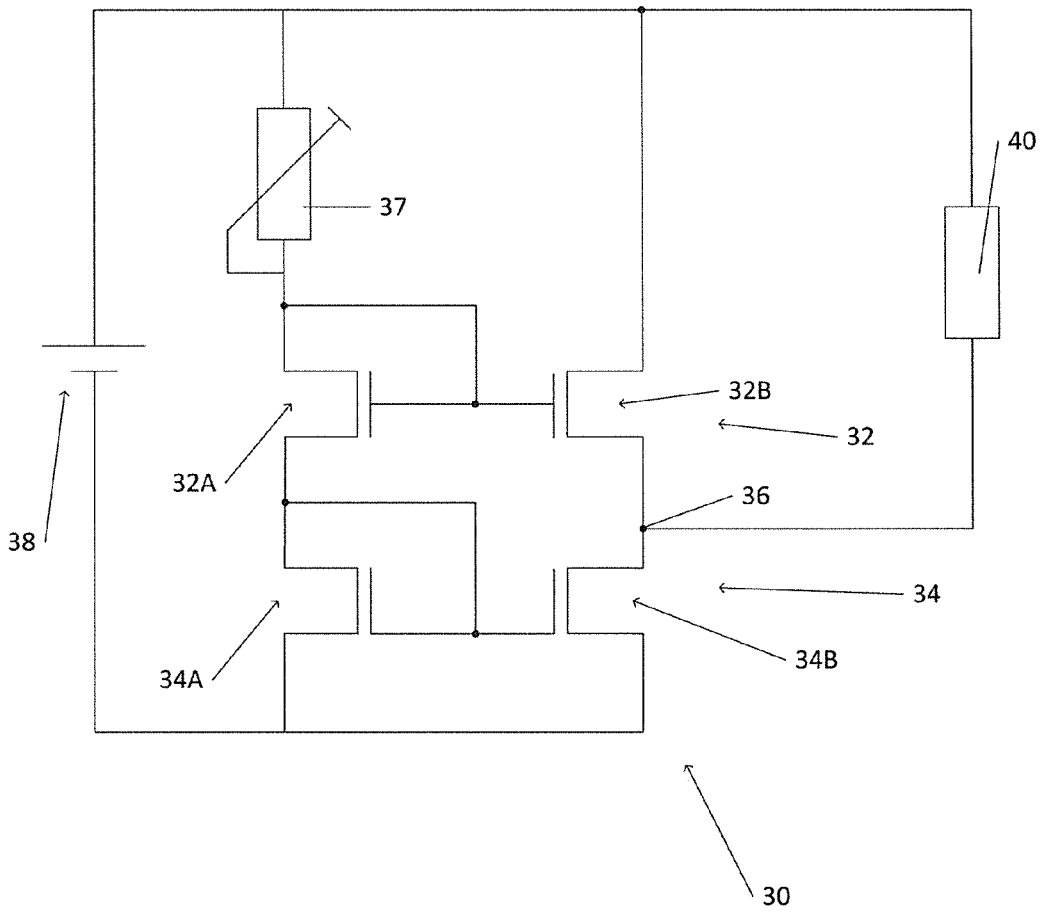
FIG. 1 is a schematic diagram of an example of a current mirror connected to a circuit.

FIG. 1 shows a schematic diagram of a current mirror according to various examples.

The transistors shown in the example of FIG. 1 are MOS N-channel transistors.

A current mirror 30 comprises a first matched set of transistors 34 comprising a first transistor 34A and a second transistor 34B arranged as a Widlar current mirror similar to the Widlar current mirror of FIG. 6. The bases of the transistors 34A and 34B are directly coupled together, and the collector of first transistor 34A is directly coupled to the base of first transistor 34A. The emitters of the transistors 34A and 34B are coupled to a first voltage level, in this example a first terminal of a power source 38.

The current mirror 30 also comprises a second matched set of transistors 32 comprising a first transistor 32A and a second transistor 32B. The second set of transistors can be described as a voltage clamp. The bases of transistors 32A and 32B are directly coupled together, and the collector of first transistor 32A is directly coupled to the base of first transistor 32A.

The emitters of transistors 32A and 32B are coupled, respectively, to the collectors of transistors 34A and 34B in series. The collectors of transistors 32A and 32B are coupled to a second voltage level, in this example a second terminal of power source 38. A variable resistor 37 is coupled in series between the collector of first transistor 32A and the second terminal of the power source 38. This can enable a desired input current to be set. However, other ways of providing a desired current to the collector of first transistor 32A can be alternatively employed.

In the example of FIG. 1, the second voltage level is positive and the first voltage level is at a lower potential, such as ground. However, alternatively, the second voltage level can be negative and the first voltage level can be at a higher potential, such as ground. However, in such a modification, the N-channel transistors would need to be replaced by P-channel transistors.

Alternatively, if the second voltage level is positive, NPN transistors can be used instead of N-channel MOS transistors. If the second voltage level is negative, PNP transistors can be used instead of P-channel MOS transistors.

A current output 36 is coupled between the emitter of the second transistor 32B of the second set of transistors 32 and the collector of the second transistor 34B of the first set of transistors 34. A load 40 can be coupled between the current output 36 and the positive terminal of the power source 38.

In operation, when the impedance of the load 40 is low, the second set of transistors 32 does not significantly modify the basic behaviour of the Widlar current mirror formed by the arrangement of the first set of transistors 34. However, when the impedance of the load 40 increases, the voltage between the collector and the emitter of the second transistor 34B decreases. However, before the second transistor 34B of the first set of transistors enters into saturation mode, the second transistor 32B of the second set of transistors drives some current from the second terminal of the power source 38 to the collector of the second transistor 34B of the first set of transistors. In this way, with any load impedance, transistors are always in the active region and do not have to recover from saturation, thereby providing an advantage over current mirrors in which transistors saturate at high load impedance. Avoiding saturation in this way can avoid a performance drop with a high load impedance.

The first set of transistors 34 can be described as providing a current mirror while the second set of transistors 32 can be described as providing a voltage clamp or voltage comparator. One of the transistors of each set 34, 32 has its base directly coupled to its collector, as described above. Transistors that have base joined with collector behave as diodes. The reason shorted transistors are provided instead of "normal" diodes is that current-to-voltage ratio of this "artificial diode" is closely matched with current-to-voltage ratio of the other transistor of the set, which can be described as the neighbor transistor.

For the first set of transistors 34, the shorted first transistor 34A is used as a "current sensor", that is, it "measures" (converts) the current circulating through it into a "small voltage" (drop across). When this small voltage reaches the "neighbor" second transistor 34B, it causes the transistor to supply in the output a current equal in magnitude to the original one. In other words, the first set of transistors 34 can be seen as having an input comprising the first transistor 34A behaving as "current sensor" and an output comprising the second transistor 34B behaving as "current regulator".

For the second set of transistors 32, the shorted first transistor 32A is used as a "voltage drop compensator". It adds a voltage to a signal in order to compensate the base-emitter voltage drop of its neighbor second transistor 32B. Therefore, the neighbor transistor 32B compares voltage in its emitter with voltage in the collector of transistor 34A. When its emitter voltage varies, for example owing to a high impedance load 40, it allows current to flow from its collector to emitter in order to re-establish emitter voltage. This prevents the first set of transistors 34 from becoming saturated.

In other words, in response to the current mirror, in particular transistor 34B, approaching saturation, the voltage clamp draws a current to the current output to prevent the current mirror saturating.

It is possible to have a resistor in series with the emitters of each of transistors of the first set of transistors 34. This technique is called "emitter degeneration" and is used as a means to reduce the error in current balance (cheaper than a Wilson add-on, but with less performance), and as a means to get some gain or loss in the output current (basic circuit has 1:1 ratio in currents). However, this is not preferred as it is cheaper to integrate transistors than resistors and current ratios other than 1:1 can be implemented inside integrated circuits via geometric relationship of transistors.

For example, in order to get an output current a factor of n times the input current, all the transistors on the side of the current output or mirrored current (which can with reference to the attached figures be described as "right side" transistors) have n times the geometric area in the base-emitter region as compared with the transistors on the side of the current input (first or "left side" transistors). For example, for the Widlar current mirror shown in FIG. 6 and described above, the base-emitter region of the second transistor 12B can be double the geometric area of the base-emitter region of the first transistor 12A in order for the current at 16 to be twice the current input at 14. For the Wilson current mirror shown in FIG. 7 and described above, the base-emitter region of the second transistors 21B, 22B can be double the geometric area of the base-emitter region of the first transistors 21A, 22A in order for the current at 26 to be twice the current input at 24. For the current mirror shown in FIG. 1 and described above, the base-emitter region of the second transistors 32B, 34B can be double the geometric area of the base-emitter region of the first transistors 32A, 34A in order for the current at the current output 36 to be twice the current input through the variable resistor 37.

Alternatively, to get an output current of 25% of the input current, the "right side" transistors can each have a base-emitter area 25% of the "left side" transistors. For example, for the current mirror shown in FIG. 1 and described above, the base-emitter region of the second transistors 32B, 34B can be 25% of the geometric area of the base-emitter region of the first transistors 32A, 32B in order for the current at the current output 36 to be 25% of the current input through the variable resistor 37.

In addition, it is possible to add a Cascode to the Widlar current mirror of FIG. 1. Preferably, this is only done with MOS transistors as implementations with bipolar transistors have inherent low impedance at base mode so low frequency pole is not problematic.

Figure 2:
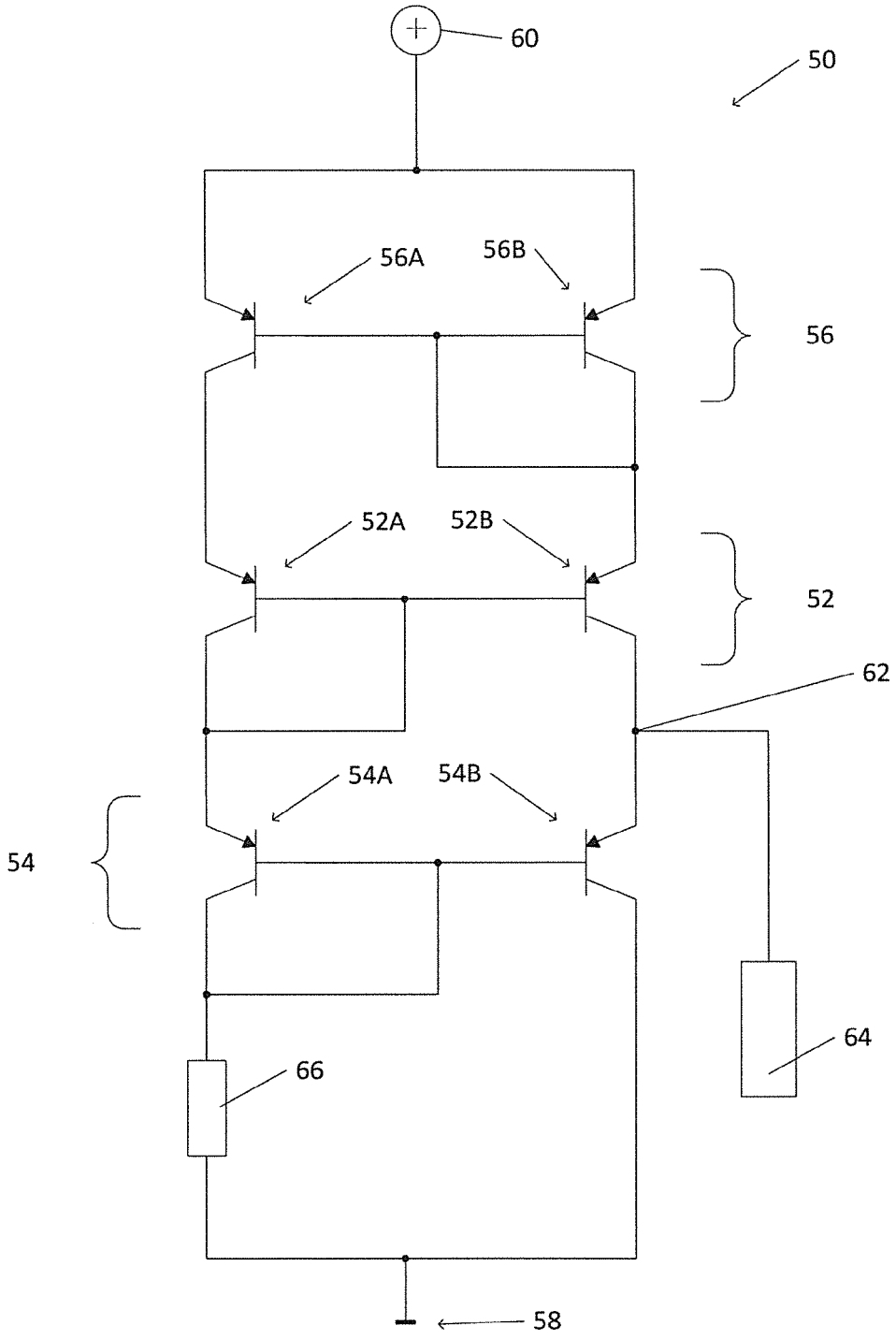
FIG. 2 is a schematic diagram of an example of a current mirror.

FIG. 2 is a schematic diagram of another example of a current mirror 50 according to various examples. The current mirror 50 comprises a first set of matched transistors 52 arranged as a Widlar current mirror. The first set of transistors 52 comprises a first transistor 52A and a second transistor 52B. The bases of the first and second transistors 52A, 52B are directly coupled together and the collector of the first transistor 52A is directly coupled to the base of the first transistor 52A.

The current mirror also comprises a second set of matched transistors 54 comprising a first transistor 54A and a second transistor 54B. The second set of transistors can be described as a voltage clamp. The bases of the first and second transistors 54A, 54B are directly coupled together and the collector of the first transistor 54A is directly coupled to its base.

The collectors of the first and second transistors 52A, 52B of the first set of transistors 52 are coupled, respectively, to the emitters of the first and second transistors 54A, 548 of the second set of transistors 54 in series.

The collectors of the first and second transistors 54A, 54B of the second set of transistors are coupled to a first voltage level 58. However, a resistor 66 is coupled in series between the collector of the first transistor 54A and the first voltage level 58. The resistor 66 is an example of a circuit that sinks current from the current mirror to set the output current. Any other device can be used to sink current equal or proportional to the output current desired. Alternatively, the resistor 66 can be omitted altogether.

The current mirror also comprises a third set of matched transistors 56 comprising a first transistor 56A and a second transistor 56B. The third set of transistors 56 act as a Wilson add-on. A Wilson add-on is a powerful means to make an output current close to the desired multiple or fraction of the input current. For example, in the case of a 1:1 ratio, it can make both input and output currents closely equal.

The bases of the first and second transistors 56A, 56B are directly coupled together and the collector of the second transistor 56B is directly coupled to the base of the second transistor 56B.

The collectors of the first and second transistors 56A, 56B of the third set of transistors 56 are coupled, respectively, to the emitters of the first and second transistors 52A, 52B of the first set of transistors 52 in series.

The emitters of the first and second transistors 56A, 56B of the third set of transistors are directly coupled to a second voltage level 60 and thereby are directly coupled together.

In the example of FIG. 2, each of the transistor sets can be implemented with a BCM62. However, BCM62 is simply an example of many possible discrete matched transistors; other ways of implementing the transistors can also be employed. For example, although BCM62 are discrete transistors, the disclosures herein may alternatively be implemented inside an integrated circuit.

In the example of FIG. 2, the second voltage level 60 is positive and the first voltage level 58 is at a lower potential, such as ground. Alternatively, the second voltage level 60 can be negative, and the first voltage level 58 can be at a higher potential, such as ground. However, in that example, the transistors 52A,B-56A,B which are shown in FIG. 2 as being PNP transistors, would need to be replaced by NPN transistors.

Alternatively, if the second voltage level is positive, P-channel MOS transistors can be used instead of PNP transistors. If the second voltage level is negative, N-channel MOS transistors can be used instead of NPN transistors.

The arrangement of the first set of transistors and the third set of transistors together form a Wilson current mirror.

A current output 62 is coupled between the collector of the second transistor 52B of the first set of transistors and the emitter of the second transistor 54B of the second set of transistors. The current output 62 can be coupled to a load 64.

As per the example of FIG. 1, in the example of FIG. 2, when the impedance of the load 64 is low, the second set of transistors 54 does not significantly modify the basic behaviour of the Wilson current mirror. When the impedance of the load 64 increases, the voltage at the current output 62 increases and before the transistors enter saturation mode, the second set of transistors 54 divert current from the load 64 to the first voltage level 58 to decrease the voltage at the current output 62.

The second set of transistors 54 can be described as providing a voltage comparator and works in an analogous manner to that described above in respect of the second set of transistors 32 of FIG. 1.

In other words, in response to the transistors of the Wilson current mirror approaching saturation, the voltage clamp draws a current from the current output 62 to prevent the current mirror from saturating.

The current mirror 50 is particularly effective as high speed and high dynamic range loads (10Ω to 10MΩ).

As described in respect of FIG. 1, the arrangement means that with any load impedance, transistors are always in the active region and do not have to recover from saturation. The current mirrors 30, 50 divert current output allowing better dynamic response where the current in the mirror is independent of load. The current mirrors of various examples can avoid saturation at high load impedance and thereby avoid the performance drop to which many other current mirrors are susceptible.

Further advantages of the current mirrors being able to be used with high impedance loads without suffering from saturation include that current sources can be used instead of resistors in bus and other applications, there are no delays due to transistors recovering from saturation in analog circuits (integrated or discrete), and Miller capacitance does not impair frequency response or cause delays. In addition, the speed is only limited by the transistor characteristics, allowing the maximum speed of the transistors to be used, for example against changing impedances. In addition, the current mirror uses only a minimal number of components. In particular, the current mirror can enhance the speed of buses having variable impedances such as I2C, CAN, and other buses sharing interrupt signals.

The current mirrors of the various examples have a much better dynamic response than pull-ups or pull-downs and are relatively tolerant to less than ideal matching.

Applications of the described current mirrors include wired OR's, open drain busses, I2C very high speed, and I2C data separators for long reach application with line drivers.

Figure 3:
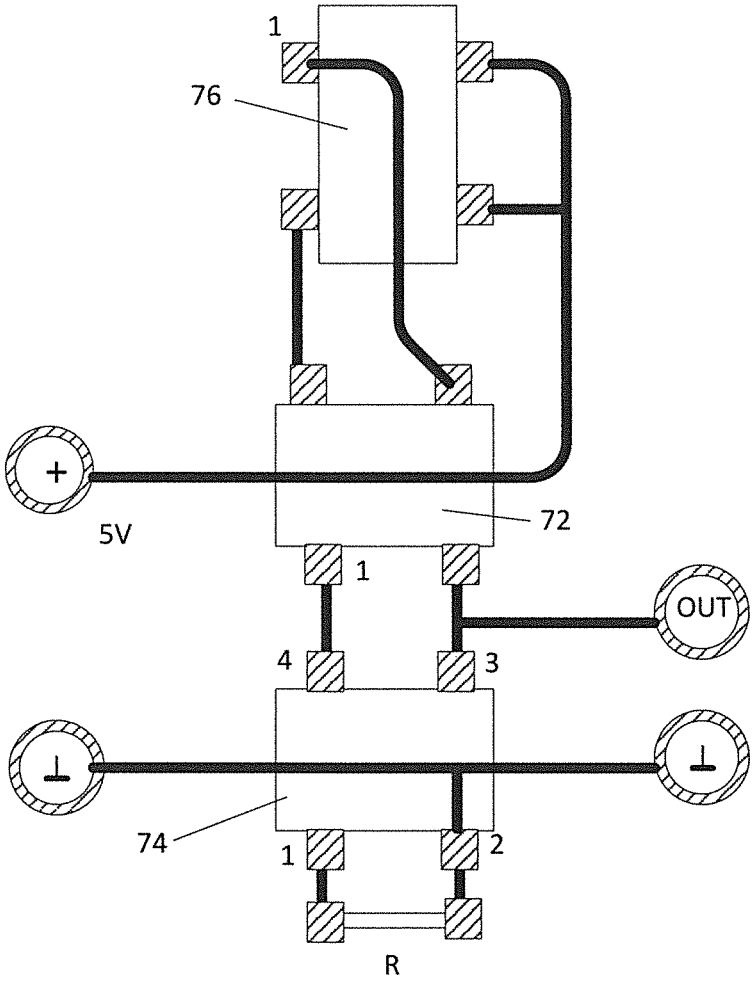
FIG. 3 is a schematic diagram of a PCB for the current mirror of FIG. 2.
Figure 4:
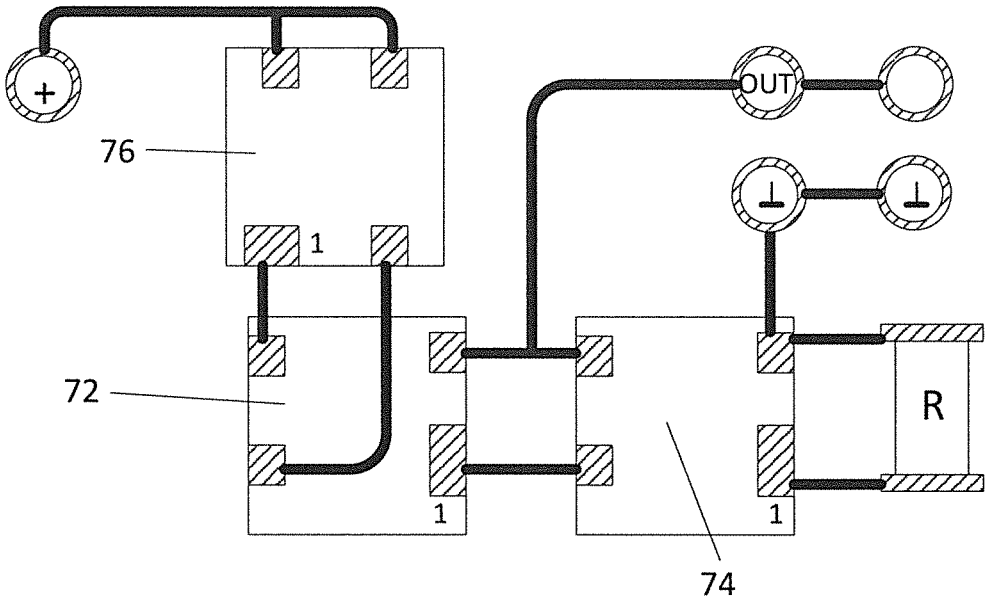
FIG. 4 is a schematic diagram of an alternative PCB for the current mirror of FIG. 2.
Figure 5:
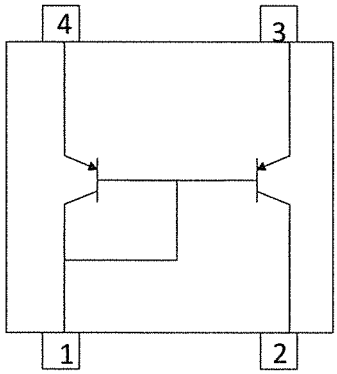
FIG. 5 is a schematic diagram of one of the transistor pair components of the PCB of FIG. 4 or FIG. 5.

FIGS. 3 and 4 show schematic diagrams of PCBs for implementing the example of FIG. 2 in which each of the sets of transistors 52, 54, 56 are provided in transistor pair components 72, 74, 76 respectively. FIG. 5 shows a schematic diagram of one of the transistor pair components 72, 74, 76.

These can be used for example as a substitute for existing Wilson current mirrors. Indeed, any of the examples can be implemented to replace an existing current mirror which did not previously include a voltage clamp.

A modification to the above examples is to include a resistor between the current output 36, 62 and the load 40, 64.

It is also possible to include a resistor between the collector of the second transistor 32B, 54B of the second set of transistors and the first voltage level. A possible benefit of this is to reduce the power dissipation of the transistor. However, an inconvenience is that speed will be degraded. A reason is that the resistor will make the collector voltage variable, and thus the parasitic (Miller) capacitance of the transistor will no longer be neutralized.

As described above in connection with the current mirror depicted in FIG. 1, for the example of FIG. 2, current ratios other than 1:1 can be implemented inside integrated circuits via geometric relationship of transistors. For example, the base-emitter region of the second transistors 52B, 54B, 56B can be double the geometric area of the base-emitter region of the first transistors 52A, 54A, 56A in order for the current at the current output 62 to be twice the current input through the resistor 66.

It is also possible to provide a current mirror with more than one current output, wherein each current output outputs a current proportional to the input current. For instance, in order to get two outputs, there are provided two columns of "right side" transistors. The bases of the additional "right side" transistors are directly coupled to the bases of the "left side" transistors.

Figure 8:
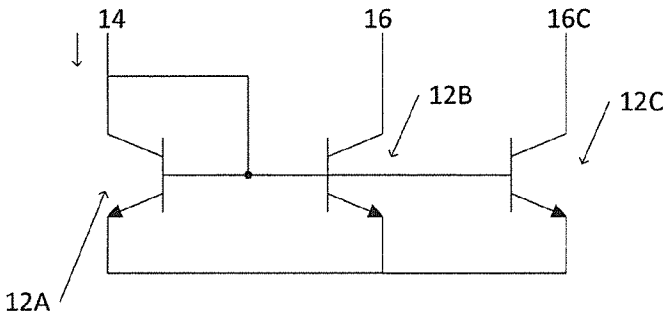
FIG. 8 is a schematic diagram of an example of a Widlar current mirror with two outputs.

An example of a Widlar current mirror with two outputs is shown in FIG. 8. The components in FIG. 8 correspond to those depicted in and described in connection with FIG. 6. An additional transistor 12C has been added to the arrangement of FIG. 6. The base of the additional transistor 12C is directly coupled to the bases of the first and second transistors 12A, 12B, and the emitter of the additional transistor 12C is coupled to ground. The collector of the additional transistor 12C is coupled to junction 16C, at which an additional mirrored current corresponding to the current at 16 is provided.

It is also possible to provide a current mirror with multiple outputs in which each output current is proportional in a different ratio to the input current.

Figure 9:
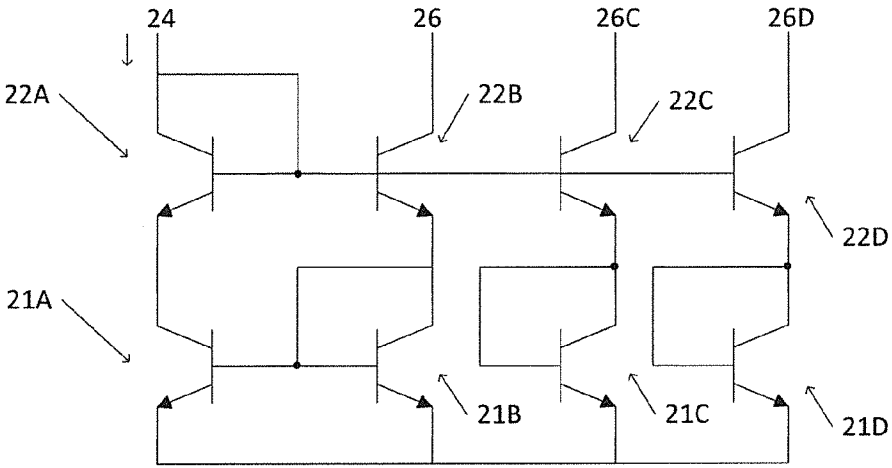
FIG. 9 is a schematic diagram of an example of a Wilson current mirror with three outputs.

FIG. 9 shows an example of a Wilson current mirror. The components in FIG. 9 correspond to those depicted in and described in connection with FIG. 7. Each of the sets of transistors comprises a third transistor 21C, 22C and a fourth transistor 21D, 22D. The bases of the third and fourth transistors 22C, 22D of the first set of transistors are directly coupled to the base of the first transistor 22A of the first set of transistors, and the emitters of the third and fourth transistors 22C, 22D of the first set of transistors are coupled, respectively, to the collectors of the third and fourth transistors 21C, 21D of the further set of transistors. As per the second transistor 21B, for each of third and fourth transistors 21C, 21D of the further set, the collector is directly coupled to the base. The emitters of the transistors of the further set of transistors are coupled together to a first voltage level.

The collectors of the second, third and fourth transistors of the first set of transistors are coupled to junctions, respectively 26, 26C, 26D at each of which an output current is produced.

As discussed above, the base-emitter region of each of the second, third and fourth transistors 21B, 22B, 21C, 22C, 21D, 22D can be a multiple or a fraction of the geometric area of the base-emitter region of the first transistors 21A, 22A in order for the currents at junctions 26, 26C, 26D to be multiples or fractions of the input current at 24.

For example, the base-emitter area of the second transistors 21B, 22B can be 60% of the base-emitter area of the first transistors 21A, 22A, the base-emitter area of the third transistors 21C, 22C can be 130% of the base-emitter area of the first transistors 21A, 22A, and the base-emitter area of the fourth transistors 21D, 22D can be 200% of the base-emitter area of the first transistors 21A, 22A. This provides a current at 26 which is 0.6 times the input current at 24, a current at 26C which is 1.3 times the input current at 24, and a current at 26D which is 2 times the input current at 24.

Figure 10:
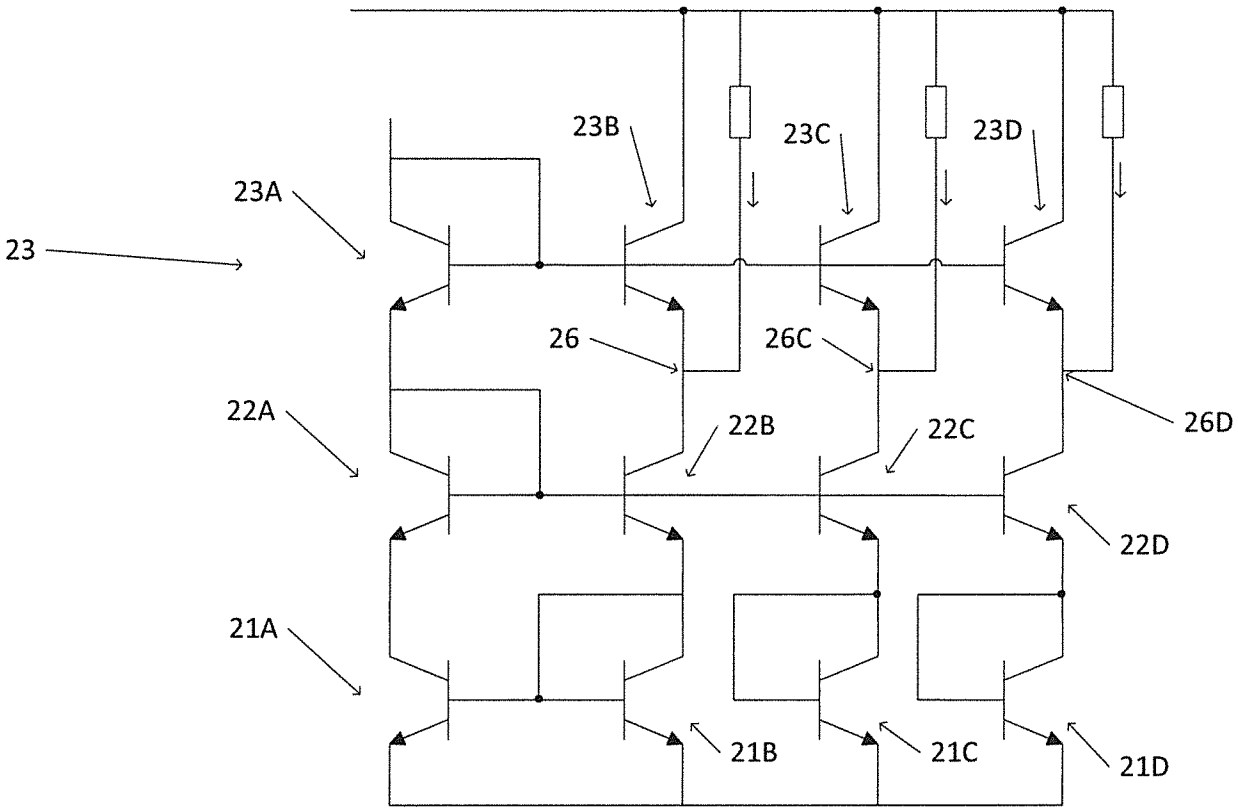
FIG. 10 is a schematic diagram of an example of a current mirror with three outputs.

FIG. 10 shows a current mirror which can be considered a Wilson current mirror as per the example of FIG. 9 with the addition of a set of transistors 23 which can be considered a voltage clamp such as described above. For consistency with examples described above, the voltage clamp set of transistors 23 can be considered a second set of transistors, and the 'further' set of transistors 21A-D can be considered a third set of transistors.

The second set of transistors 23 comprises first, second, third and fourth transistors 23A, 23B, 23C, 23D. The emitters of the first, second, third and fourth transistors 23A, 23B, 23C, 23D of the second set of transistors are coupled, respectively to the collectors of the first, second, third and fourth transistors 22A, 22B, 22C, 22D of the first set of transistors in series. The bases of the transistors of the second set of transistors 23 are all directly coupled together. The collector of the first transistor 23A of the second set of transistors is directly coupled to the base of the first transistor 23A of the second set of transistors. An input current can be coupled to the collector of the first transistor 23A of the second set of transistors.

The collectors of the second, third and fourth transistors 23B, 23C, 23D of the second set of transistors are coupled to a second voltage level, and a load can be coupled between each of the junctions 26, 26C, 26D and the second voltage level.

As discussed above, the base-emitter region of each of the second, third and fourth transistors 21B, 22B, 23B, 21C, 22C, 23C, 21D, 22D, 23D can be a multiple or a fraction of the geometric area of the base-emitter region of the first transistors 21A, 22A, 23A in order for the currents at junctions 26, 26C, 26D to be multiples or fractions of the input current to the collector of transistor 23A.

For example, the base-emitter area of the second transistors 21B, 22B, 23B can be 130% of the base-emitter area of the first transistors 21A, 22A, 23A, the base-emitter area of the third transistors 21C, 22C, 23C can be 60% of the base-emitter area of the first transistors 21A, 22A, 23A, and the base-emitter area of the fourth transistors 21D, 22D, 23D can be 150% of the base-emitter area of the first transistors 21A, 22A, 23A. This provides a current at 26 which is 1.3 times the input current, a current at 26C which is 0.6 times the input current, and a current at 26D which is 1.5 times the input current.

Similar to as described above, the example of FIG. 10 operates as follows. When the impedance of any of the loads is low, the second set of transistors 23 does not significantly modify the basic behaviour of the Wilson current mirror formed by the arrangement of the first and third sets of transistors. However, when the impedance of a load increases, the voltage between the collector and the emitter of the corresponding transistor 22B, 22C, 22D of the first set of transistors decreases. However, before that transistor enters into saturation mode, the corresponding transistor 23B, 23C, 23D of the second set of transistors drives some current from the second voltage level to the collector of the corresponding transistor 22B, 22C, 22D of the first set of transistors. 'Corresponding' transistors are those coupled in series with the current output 26, 26C, 26D to which that load is coupled. In this way, with any load impedance, transistors are always in the active region and do not have to recover from saturation.

In the example depicted in FIG. 10, the second voltage level is positive, and the first voltage level is at a lower potential, such as ground. Alternatively, as described above, the second voltage level can be negative, and the first voltage level can be at a higher potential, such as ground. However, in that example, the transistors 21A-D, 22A-D, 23A-D which are shown in FIG. 10 as being NPN transistors, would need to be replaced by PNP transistors.

Alternatively, if the second voltage level is positive, N-channel MOS transistors can be used instead of NPN transistors. If the second voltage level is negative, P-channel MOS transistors can be used instead of PNP transistors.

Where components are described above as being coupled, they can be directly coupled or connected, that is with no intermediate components.

Where two components are coupled and a further component is described as being coupled between them, that is to say that the further component is coupled to the coupling which couples the two components. Thereby, the further component is coupled to both of the two components.

Throughout the description above and claims below, transistors are described as having a base, collector and emitter. However, the term 'base' is used to refer to the base or the gate of a transistor, the term 'collector' is used to refer to the collector or the drain of a transistor, and the term 'emitter' is used to refer to the emitter or the source of a transistor. This is because bipolar transistors, field effect transistors, or any other type of transistors can be used. For example, in FIG. 1, the transistors are shown as MOS N channel transistors, but nevertheless the terms collector, emitter and base have been used.

Although each of the sets of transistors has been described as being a matched set, different sets of transistors do not need to be matched to each other.

Features and modifications of the examples described above can be combined and/or interchanged as required.

The invention claimed is:

1. A current mirror, comprising:

first and second sets of transistors, each of the first and second sets comprising a first transistor and a second transistor, wherein the base of the first transistor is directly coupled to the base of the second transistor, wherein, for the first transistor of each set, the base is directly coupled to the collector, wherein the collector of the first transistor of the first set is coupled to the emitter of the first transistor of the second set, and the collector of the second transistor of the first set is coupled to the emitter of the second transistor of the second set so that the emitters of the first and second transistors of the second set are respectively to receive currents from the collectors of the first and second transistors of the first set, and wherein an output of the current mirror is coupled to the collector of the second transistor of the first set and the emitter of the second transistor of the second set.

2. The current mirror of claim 1, further comprising a third set of transistors, the third set of transistors comprising a first transistor and a second transistor, wherein the base of the first transistor is directly coupled to the base of the second transistor, wherein, for one of the first and second transistors, the base is directly coupled to the collector, and wherein the collectors of the first and second transistors of the third set are coupled, respectively, to the emitters of the first and second transistors of the first set in series.

3. The current mirror of claim 2, wherein the emitters of the first and second transistors of the third set are directly coupled together.

4. The current mirror of claim 2, wherein, for the second transistor of the third set, the base is directly coupled to the collector.

5. The current mirror of claim 1, wherein the collectors of the first and second transistors of the second set are coupled to a first voltage level and the emitters of the first and second transistors of the first set are coupled to a second voltage level.

6. The current mirror of claim 5, wherein a resistor is coupled in series between the collector of the first transistor of the second set and the first voltage level.

7. The current mirror of claim 1, wherein the output of the current mirror is to be connected to a load.

8. The current mirror of claim 1, wherein the first and second sets of transistors each comprise a third transistor; wherein for the third transistor of the first set of transistors:

the base is directly coupled to the base of the first transistor of the first set of transistors, and the collector is coupled to the emitter of the third transistor of the second set of transistors in series; wherein for the third transistor of the second set of transistors the base is directly coupled to the base of the first transistor of the second set of transistors; further wherein a second current output of the current mirror is coupled between the collector of the third transistor of the first set and the emitter of the third transistor of the second set.

9. The current mirror of claim 1, wherein base-emitter regions of the second transistors are a factor of n times the area of base-emitter regions of the first transistors.

10. The current mirror of claim 9, wherein n=1.

11. A current mirror assembly comprising:

a current mirror comprising a current input and a current output, the current mirror to supply a current at the current output substantially proportional to a current at the current input; and a voltage clamp coupled between ground and the current output of the current mirror and including two transistors having control electrodes coupled to each other, wherein the voltage clamp draws a current in response to the current mirror approaching saturation, preventing saturation in the current mirror.

12. A method of manufacturing a current mirror, comprising:

providing first and second sets of transistors, each of the first and second sets comprising a first transistor and a second transistor, wherein the base of the first transistor is directly coupled to the base of the second transistor, and wherein, for the first transistor of each set, the base is directly coupled to the collector;

coupling the collector of the first transistor of the first set to the emitter of the first transistor of the second set so that the emitter of the first transistor of the second set is to receive a current from the collector of the first transistor of the first set;

coupling the collector of the second transistor of the first set to the emitter of the second transistor of the second set so that the emitter of the second transistor of the second set is to receive a current from the collector of the second transistor of the first set; and coupling an output of the current mirror to the collector of the second transistor of the first set and the emitter of the second transistor of the second set.

* * * * *